US006971977B1

(12) United States Patent
Chen

(10) Patent No.: US 6,971,977 B1
(45) Date of Patent: Dec. 6, 2005

(54) EXERCISE DEVICE

(76) Inventor: Chih-Liang Chen, No. 10, Lane 1431, Kuanghsing Rd., Pateh City, Taoyuan Hsien (TW)

( * ) Notice: Subject to any disclaimer, the term of this patent is extended or adjusted under 35 U.S.C. 154(b) by 0 days.

(21) Appl. No.: 10/856,824

(22) Filed: Jun. 1, 2004

(51) Int. Cl.[7] ..... A63B 26/00; A63B 71/00

(52) U.S. Cl. ..... 482/140; 482/121; 482/907; 482/142; 297/258.1

(58) Field of Search ..... 482/140, 142, 482/121–130, 907; 297/258.1, 259, 300.1; 601/49

(56) References Cited

U.S. PATENT DOCUMENTS 4,765,614 A * 8/1988 Shute ..... 482/133
6,258,016 B1 * 7/2001 Kuo ..... 482/142
6,283,900 B1 * 9/2001 Tornabene ..... 482/122
6,450,578 B1 * 9/2002 Taggett ..... 297/325
6,544,151 B2 * 4/2003 Tornabene ..... 482/122
6,656,095 B2 * 12/2003 Fernandez ..... 482/142
D490,868 S * 6/2004 Tornabene ..... D21/690
2005/0075224 A1 * 4/2005 Lin ..... 482/130

* cited by examiner

*Primary Examiner*—Gregory L. Huson
*Assistant Examiner*—L. Amerson
(74) *Attorney, Agent, or Firm*—Rosenberg, Klein & Lee

(57) ABSTRACT

An exercise device has a frame a transverse support, a backrest assembly, a sliding stand assembly, a seat, a first elastic band, a second elastic band and two optional elastic cords. The transverse support is mounted on the frame. The backrest assembly is attached pivotally to the transverse support. The sliding stand assembly slides on the transverse support. The seat is mounted on the frame. The first elastic band is mounted between the transverse support and the backrest assembly. The second elastic band is mounted between the frame and the sliding stand assembly. The exercise device can exercise different muscles of the human body without squatting on the floor.

12 Claims, 8 Drawing Sheets

EXERCISE DEVICE

BACKGROUND OF THE INVENTION

1. Field of the Invention

The present invention relates to an exercise device, and more particularly to an exercise device that can exercise different muscles of the human body.

2. Description of Related Art

People participate in sports to maintain their health. For example, people may run, play football, basketball or other field sports. However, a sports field is available to only a limited number people and may not be appropriate for a large number of people on a holiday. In addition, people usually are charged for use of the sports field. Therefore, conventional exercises device have been developed for people to exercise indoors.

With reference to the FIG. 7, a conventional exercise device in accordance with the prior art comprises a frame (70), two handles (71), a backrest (72), a headrest (73), two rockers (76), a pivoting stand (77), a roller (78) and an elastic band (79).

The frame (70) has a top end (not numbered), a bottom end (not numbered), a front (not numbered) and a back (not numbered). The handles (71) are mounted at the bottom end and extend perpendicular from the front of the frame (70). The backrest (72) is mounted on the front of the frame (70) and has a back (not numbered). The headrest (73) is mounted at the top end of the frame (70). The rockers (76) are mounted on the back of the backrest (72). The pivoting stand (77) is mounted on the back of the frame between the rockers (76) and has a distal end (not numbered). The roller (78) is rotatably mounted at the distal end of the pivoting stand (77). The elastic band (79) is mounted between the back of the frame (70) and the pivoting stand (77).

With further reference to FIG. 8, a person uses the conventional exercise device by squatting on the floor, grasping the handles (71) and pivoting against the backrest (70). The user and the exercise device recline as the exercise device pivots on the rockers (76), extends the pivoting stand (77) and stretches the elastic band (79). When the user relaxes, the elastic band (79) pulls the pivoting stand (77) toward the backrest (72), and the person and the exercise device pivot to an upright position.

However, the conventional exercise device only exercises a person's abdomen and will not fulfill the needs of people that need to exercise other parts of their body. Furthermore, squatting on the floor to use the conventional exercise device is very inconvenient.

To overcome the shortcomings, the present invention provides an exercise device to mitigate or obviate the aforementioned problems.

SUMMARY OF THE INVENTION

The main objective of the invention is to provide an exercise device that can exercise different muscles of the human body and obviates the necessity to squat on the ground to use the exercise device.

The exercise device in accordance with the present invention comprises a frame, a transverse support, a backrest assembly, a sliding stand assembly, a seat, a first elastic band, a second elastic band and two optional elastic cords. The transverse support is mounted on the frame. The backrest assembly is attached pivotally to the transverse support.

The sliding stand assembly slides on the transverse support. The seat is mounted on the frame. The first elastic band is mounted between the transverse support and the backrest assembly. The second elastic band is mounted between the frame and the sliding stand assembly.

Other objectives, advantages and novel features of the invention will become more apparent from the following detailed description when taken in conjunction with the accompanying drawings.

DETAILED DESCRIPTION OF PREFERRED EMBODIMENT

Figure 1:
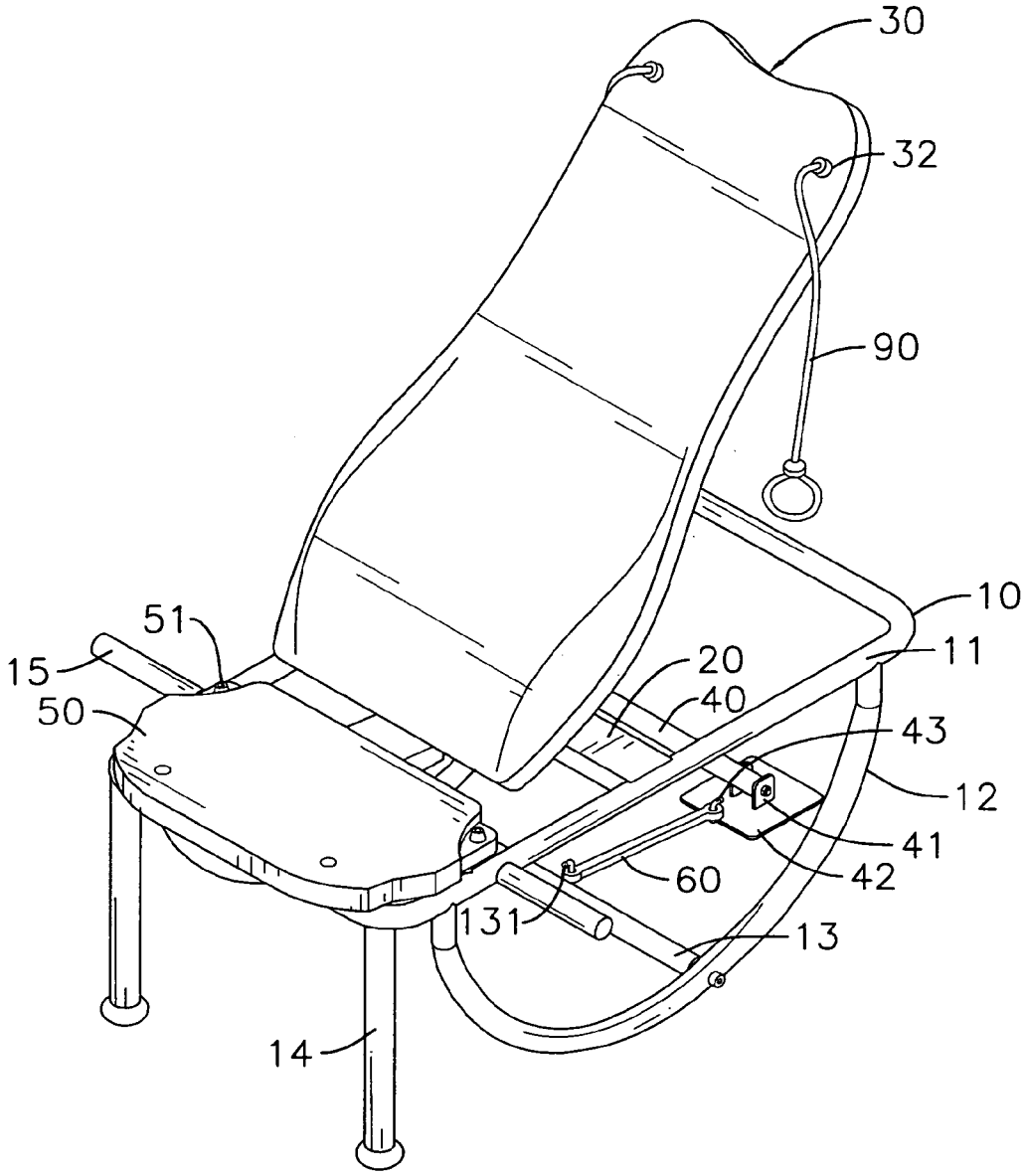
FIG. 1 is a perspective view of an exercise device in accordance with the present invention.
Figure 2:
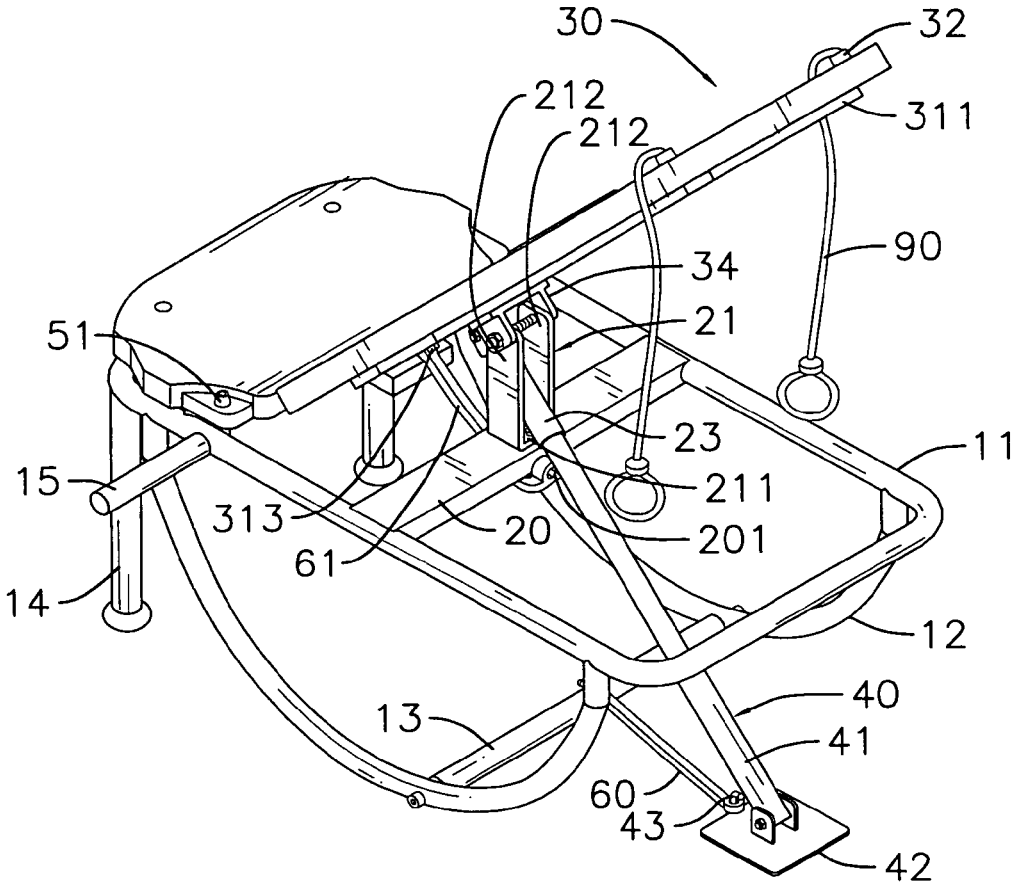
FIG. 2 is another perspective view of the exercise device in FIG. 1.
Figure 3:
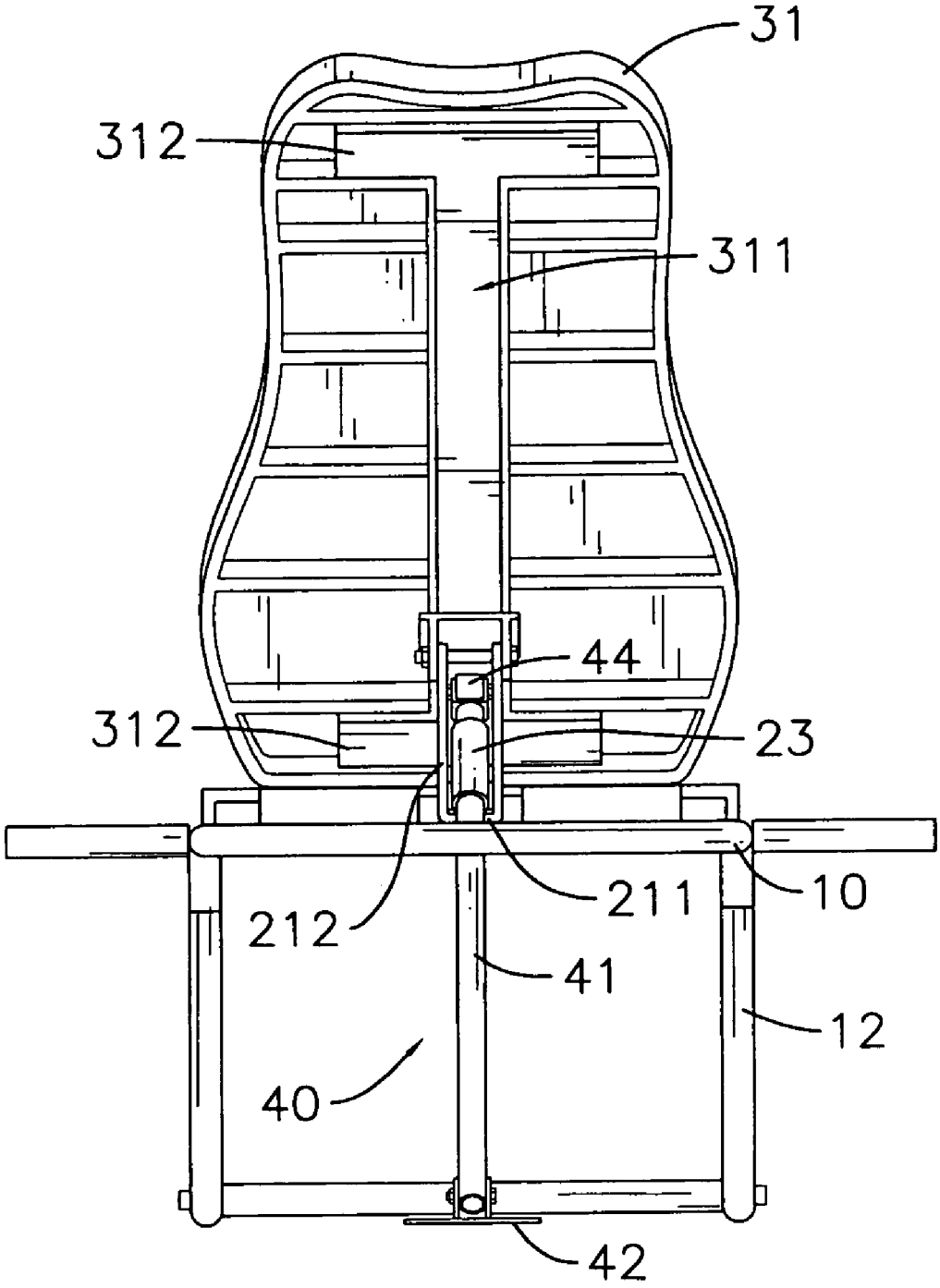
FIG. 3 is a rear view of the exercise device in FIG. 1.

With reference to FIGS. 1, 2 and 3, an exercise device in accordance with the present invention comprises a frame (10), a transverse support (20), a backrest assembly (30), a sliding stand assembly (40), a seat (50), a first elastic band (61), a second elastic band (60) and two elastic cords (90).

The frame (10) is rectangular and has a front, two longitudinal side bars (11), two handles (15), two rockers (12), a transverse stabilizer (13) and two legs (14). The two handles (15) are mounted respectively on and extend out from the longitudinal side bars (11) close to the front of the frame (10). The two rockers (12) are parallel to each other and correspond to and are attached respectively to the longitudinal side bars (11). Each rocker (12) has two ends attached to the corresponding longitudinal side bar (11). The transverse stabilizer (13) is mounted between the rockers (12) and has a transverse stabilizer hook (131). The legs (14) are attached to the front of the frame (10).

The transverse support (20) is connected to the longitudinal side bars (11) and has a transverse support hook (201) and a bracket (21). The bracket (21) is mounted on the transverse support (20) and has a base (211), two ears (212) and a sleeve (23). The base (211) of the bracket (21) is mounted on the transverse support (20). The two ears (212) extend from the base (211) of the bracket (21), and each has a distal end. The sleeve (23) is mounted between the ears (212) of the bracket (21).

The backrest assembly (30) is pivotally connected to the distal ends of the ears (212) of the bracket (21) and has a backrest (31), a spine (311), a spine hook (313), a pivot bracket (34) and two optional upper cord connectors (32). The backrest (31) has a top, a bottom, two sides, a front and a back. The spine (311) is mounted on the back of the backrest (31) and has a top end, a bottom end and two optional transverse members (312). The transverse members (312) are defined respectively at the top end and the bottom end of the spine (311), are perpendicular to the spine (311)

and are parallel to each other. The spine hook (313) is defined at the bottom end of the spine (311) and corresponds to the transverse support hook (201) on the transverse support (20). The pivot bracket (34) is mounted on the spine (311) close to the bottom end of the spine (311) and is pivotally attached to the distal ends of the bracket (21) on the transverse support (20). The two upper cord connectors (32) are defined on the front of the backrest (31) near the top of the backrest (31) and are respectively close to the sides of the backrest (31).

The sliding stand assembly (40) is mounted slidably through the sleeve (23) attached to the bracket (21) and has a longitudinal stand (41), an optional base (42) and a stand hook (43). The longitudinal stand (41) passes through and slides inside the sleeve (23) in the bracket (21) and has a top end, a bottom end and a roller (44). The roller (44) is mounted on the top end of the longitudinal stand (41) and abuts the spine (311). The optional base (42) is connected pivotally to the bottom end of the longitudinal stand (41) and has a flat bottom surface (to slide smoothly on a floor (not shown). The stand hook (43) is mounted at the bottom end of the longitudinal stand (41) and corresponds to the transverse stabilizer hook (131) on the transverse stabilizer (13). In one embodiment of the exercise device in accordance with the present invention, the stand hook (43) is attached to the base (42). In another embodiment of the exercise device in accordance with the present invention, the stand hook (43) is attached to the bottom end of the longitudinal stand (41).

The seat (50) is mounted on the front of the frame (10), has two sides, a back and two optional lower cord connectors (51). The back of the seat (50) is adjacent to the bottom of the backrest (31). The two lower cord connectors (51) are formed on the back of the seat (50) respectively on the sides.

The first elastic band (61) is made of elastic material and is attached between the spine hook (313) on the spine (311) and the transverse support hook (211) on the transverse support (20). The second elastic band (60) is made of elastic material and is attached between the stand hook (43) on the longitudinal stand (41) and the transverse stabilizer hook (131) on the transverse stabilizer (13).

Two elastic cords (90) are made of elastic material, are attached detachably and respectively to the upper cord connectors (32) on the backrest (31) or to the lower cord connectors (51) on the seat (50).

The exercise device has multiple capabilities and can be used to exercise muscles in a person's back, arms, torso, etc.

Figure 4:
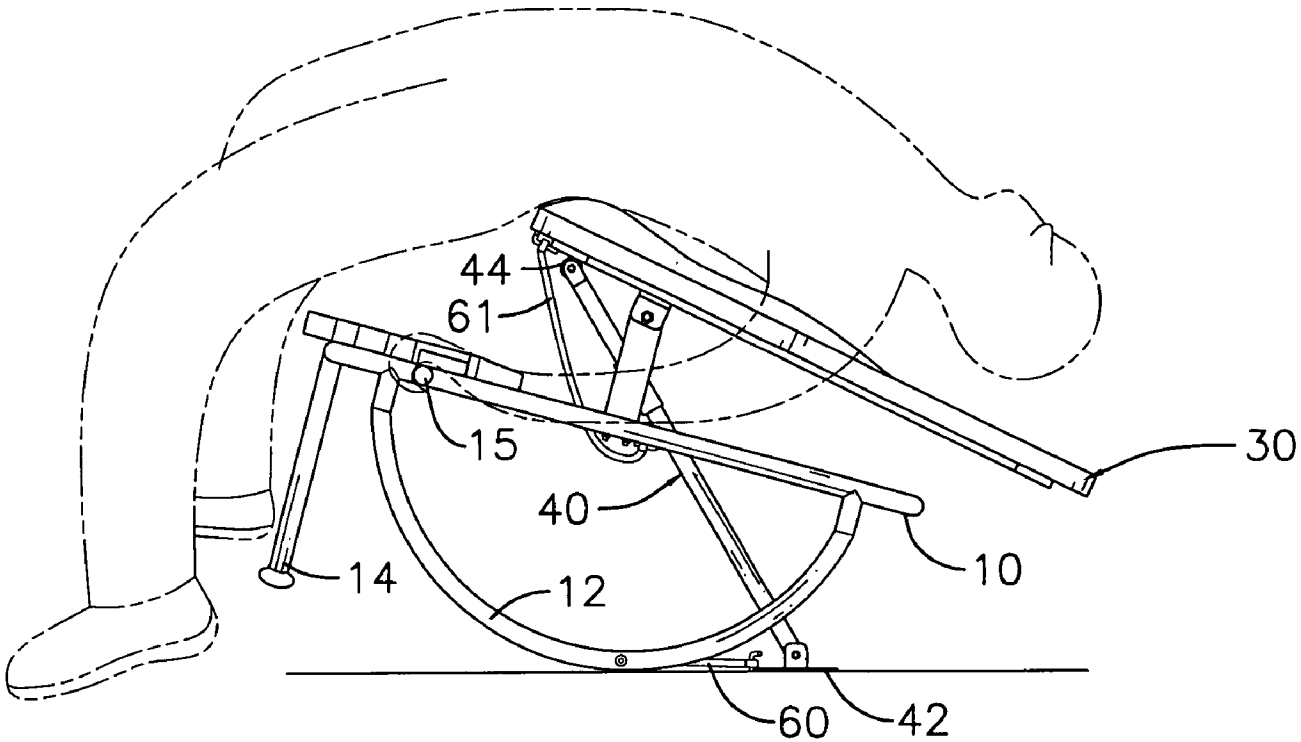
FIG. 4 is an operational side view of the exercise device in FIG. 1 in use.

With reference to FIG. 4, a person uses the exercise device to exercise back muscles by sitting on the seat, grasping the handles (15) and pressing his back against the front of the backrest (31) with force. The backrest assembly (30) pivots on the bracket (21) of the transverse support (10), and the top of the backrest (31) pivots down and the bottom of the backrest (31) pivots up. The longitudinal stand (41) slides inside the sleeve (23) of the transverse support (20), the roller (44) of the longitudinal stand (41) rolls on the spine (311) toward the bottom end of the spine (311). The first elastic band (61) stretches longitudinally. The rockers (12) rock on the floor, and the legs (14) lift off the floor. When the user relaxes, the first elastic band (61) pulls the backrest assembly (30) to an upright position. As the backrest assembly (30) returns to an upright position, the roller (44) is pushed, and the longitudinal stand (41) is pushed through the sleeve (23) so the bottom end of the longitudinal stand (41) presses against the floor and pushes the legs (14) back against the floor.

Figure 5:
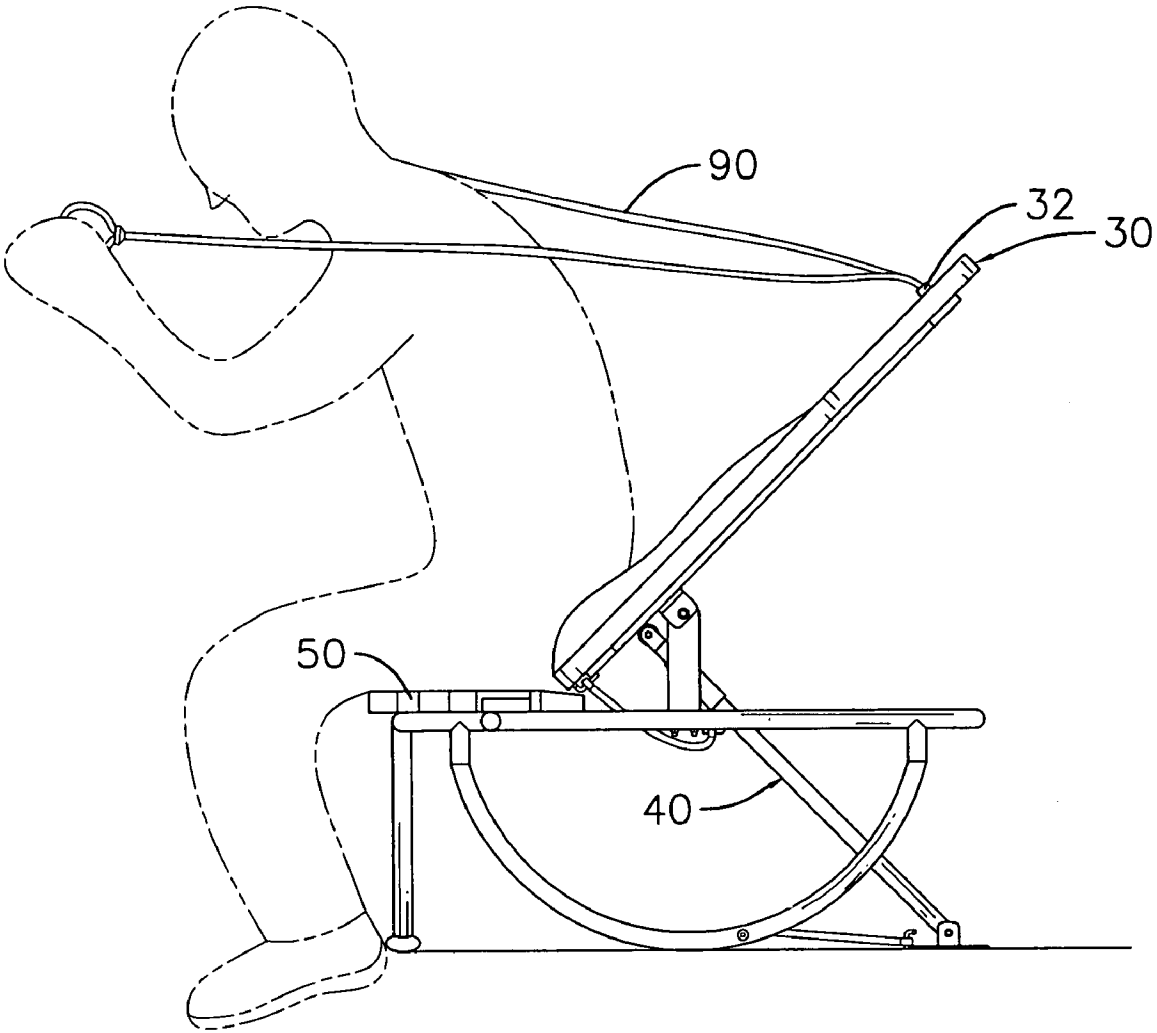
FIG. 5 is another operational side view of the exercise device in FIG. 1 in use.

With reference to FIGS. 1, 2 and 5, a person exercises torso and arm muscles by sitting on the seat and stretching the elastic cords (90) attached to the upper cord connectors (32) on the backrest (31). When the elastic cords (90) are pulled, the spine (311) on the back of the backrest (31) abuts the roller (11) on the longitudinal stand (41) to prevent the backrest assembly (30) from pivoting. By sitting up or bending the arms, the user can exercise selected muscles.

Figure 6:
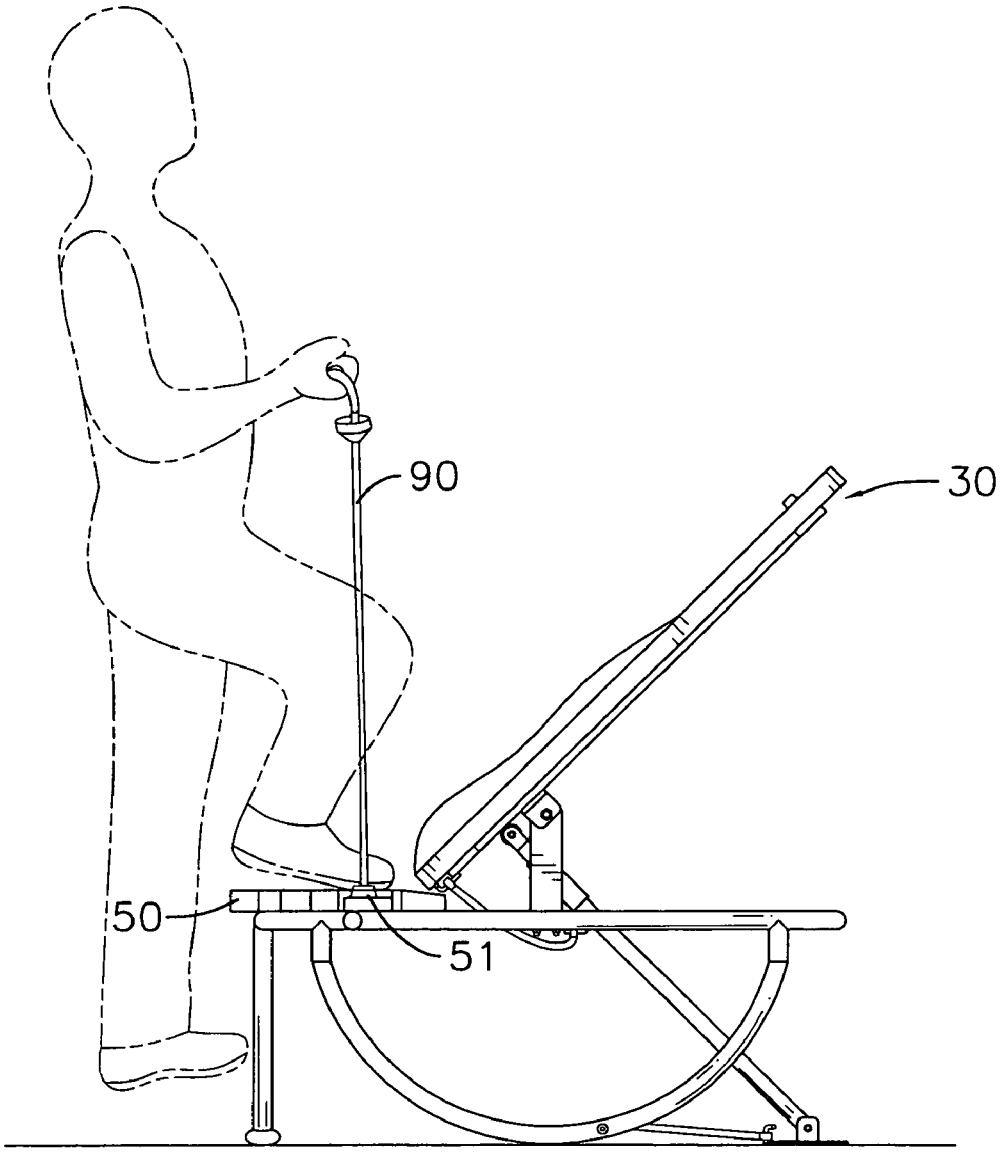
FIG. 6 is another operational side view of the exercise device in FIG. 1 in use.
Figure 7:
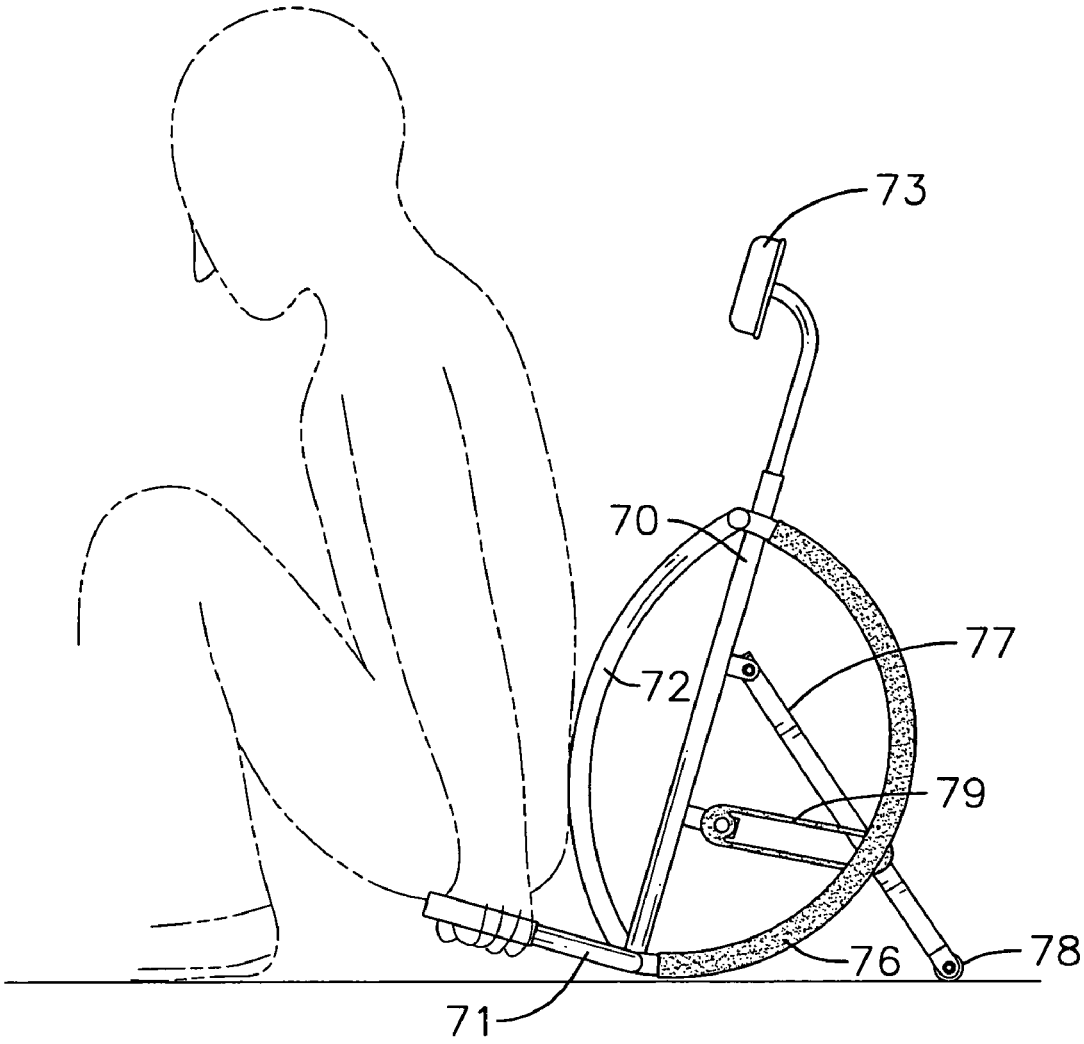
FIG.7 PRIOR ART
FIG. 7 is an operational side view of a conventional exercise device in accordance with the prior art in use.
Figure 8:
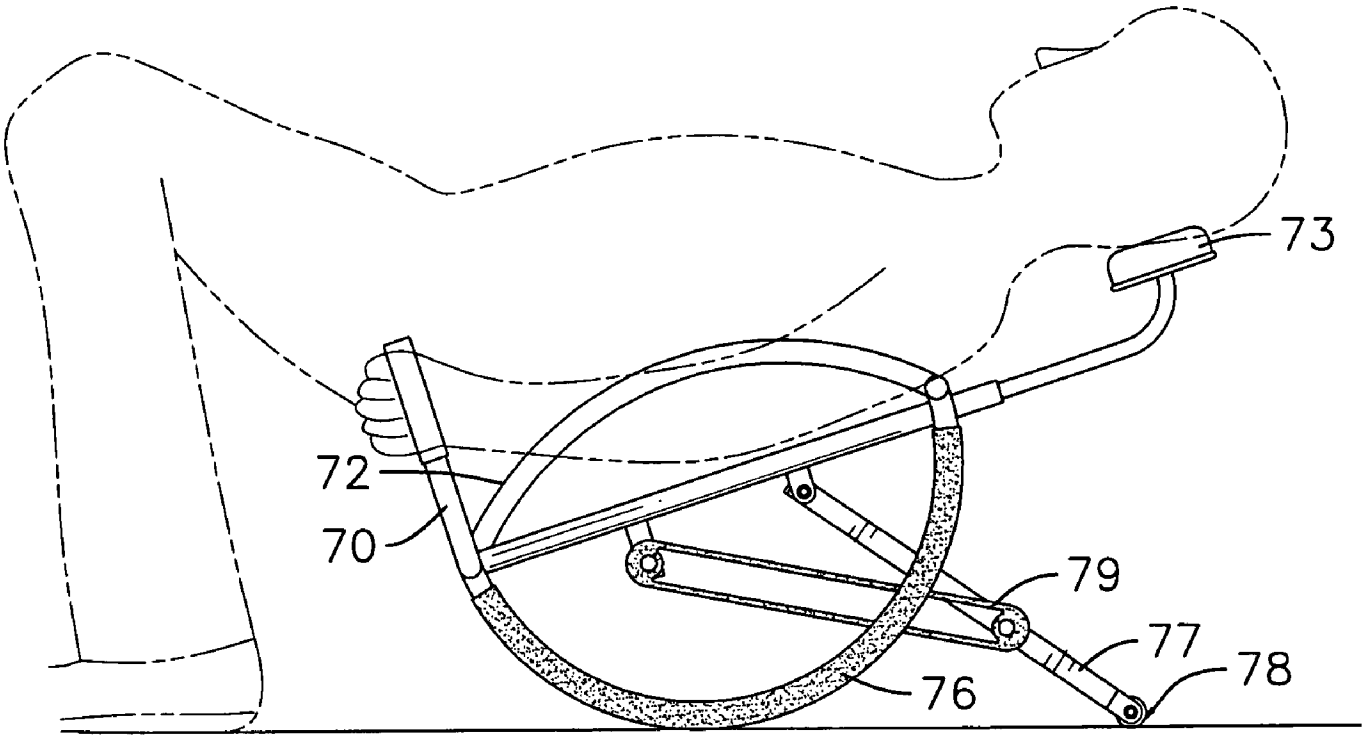
FIG. 8 PRIOR ART
FIG. 8 is another operational side view of the conventional exercise device in FIG. 7 in use.

With reference to FIG. 6, a person can pull the elastic cords (90) attached to the lower cord connectors (51) on the seat (50) to selectively exercise another group of muscles in the arms and legs.

The exercise device in accordance with the invention has multiple capabilities, is convenient to use and does not require that a person using the exercise device squat on the floor.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An exercise device comprising:

a frame having
- a front;
- two longitudinal side bars;
- two handles mounted respectively on the longitudinal side bars close to the front on the frame;
- two rockers parallel to each other, corresponding to and attached respectively to the longitudinal side bars and each having
  - two ends attached to the corresponding longitudinal side bar;
- a transverse stabilizer mounted between the rockers and having a transverse stabilizer hook; and
- two legs attached to the front of the frame;

a transverse support connected to the longitudinal side bars and having
- a transverse support hook; and
- a bracket mounted on the transverse support and having
  - a base mounted on the transverse support;
  - two ears extending from the base of the bracket and each having a distal end; and
  - a sleeve mounted between the ears above the base of the bracket;
- a backrest assembly pivotally connected to the distal ends of the ears of the bracket and having
  - a backrest having a top, a bottom, two sides, a front and a back;
  - a spine mounted on the back of the backrest and having a top end and a bottom end;
  - a spine hook defined at the bottom end of the spine, corresponding to the transverse support hook on the transverse support; and
  - a pivot bracket mounted on the spine close to the bottom end of the spine and pivotally attached to the distal ends of the bracket on the transverse support;
- a sliding stand assembly mounted slidably through the sleeve and having
  - a longitudinal stand passing through and sliding inside the sleeve, and having
    - a top end;
    - a bottom end; and
    - a roller attached to the top end; and a stand hook defined near the bottom end of the longitudinal stand and corresponding to the transverse stabilizer hook of the transverse stabilizer;

a seat mounted on the front of the frame and having two sides and a back close to the bottom of the backrest;

a first elastic band made of elastic material and attached between the spine hook on the spine and the transverse support hook on the transverse support; and a second elastic band made of elastic material attached between the stand hook of the longitudinal stand and the transverse stabilizer hook on the transverse stabilizer.

2. The exercise device as claimed in claim 1, wherein the spine of the backrest assembly further comprises two transverse members defined respectively at the top end and the bottom end of the spine and perpendicular to the spine and parallel to each other.

3. The exercise device as claimed in claim 1, wherein the longitudinal stand of the sliding stand assembly further comprises a base connected pivotally to the bottom end of the longitudinal stand and having a flat bottom surface; and the stand hook near the bottom end of the longitudinal stand is defined on the base.

4. The exercise device as claimed in claim 2, wherein the longitudinal stand of the sliding stand assembly further comprises a base connected pivotally to the bottom end of the longitudinal stand and having a flat bottom surface; and the stand hook near the bottom end of the longitudinal stand is defined on the base.

5. The exercise device as claimed in claim 1, wherein the backrest further comprises two upper cord connectors defined on the front of the backrest, near the top of the backrest and respectively close to the sides of the backrest; and two elastic cords made of elastic material and detachably attached respectively to the upper cord connectors on the backrest.

6. The exercise device as claimed in claim 2, wherein the backrest further comprises two upper cord connectors defined on the front of the backrest, near the top of the backrest and respectively close to the sides of the backrest; and two elastic cords made of elastic material and detachably attached respectively to the upper cord connectors on the backrest.

7. The exercise device as claimed in claim 3, wherein the backrest further comprises two upper cord connectors defined on the front of the backrest, near the top of the backrest and respectively close to the sides of the backrest; and two elastic cords made of elastic material and detachably attached respectively to the upper cord connectors on the backrest.

8. The exercise device as claimed in claim 4, wherein the backrest further comprises two upper cord connectors defined on the front of the backrest, near the top of the backrest and respectively close to the sides of the backrest; and two elastic cords made of elastic material and detachably attached respectively to the upper cord connectors on the backrest.

9. The exercise device as claimed in claim 1, wherein the seat further comprises two lower cord connectors defined on the back of the seat and respectively on the sides of the seat; and two elastic cords made of elastic material and detachably attached respectively to the lower cord connectors on the seat.

10. The exercise device as claimed in claim 2, wherein the seat further comprises two lower cord connectors defined on the back of the seat, respectively on the sides of the seat; and two elastic cords made of elastic material, detachably attached respectively to the lower cord connectors on the seat.

11. The exercise device as claimed in claim 3, wherein the seat further comprises two lower cord connectors defined on the back of the seat, respectively on the sides of the seat; and two elastic cords made of elastic material, detachably attached respectively to the lower cord connectors on the seat.

12. The exercise device as claimed in claim 4, wherein the seat further comprises two lower cord connectors defined on the back of the seat, respectively on the sides of the seat; and two elastic cords made of elastic material, detachably attached respectively to the lower cord connectors on the seat.

* * * * *